United States Patent [19]

Larsen

[11] Patent Number: 4,938,025

[45] Date of Patent: Jul. 3, 1990

[54] POWER CONVERSION MACHINE HAVING PISTONS WHICH ARE MOVED IN A TURNING MOVEMENT IN A SPHERICAL HOUSING

[75] Inventor: Thor Larsen, Fyllingsdalen, Norway

[73] Assignee: 3D International A/S, Oslo, Norway

[21] Appl. No.: 217,825

[22] PCT Filed: Nov. 16, 1987

[86] PCT No.: PCT/NO87/00074

§ 371 Date: Jul. 12, 1988

§ 102(e) Date: Jul. 12, 1988

[87] PCT Pub. No.: WO88/03986

PCT Pub. Date: Jun. 2, 1988

[30] Foreign Application Priority Data

Nov. 24, 1986 [NO] Norway ..... 864684

[51] Int. Cl.[5] ..... F02G 1/044; F02G 1/05; F01C 3/06

[52] U.S. Cl. ..... 60/518; 60/519; 418/53

[58] Field of Search ..... 418/53, 68, 195; 60/518, 519

[56] References Cited

U.S. PATENT DOCUMENTS 826,985 7/1906 Appel ..... 418/68
3,509,718 5/1970 Fezer et al. ..... 60/519
4,228,656 10/1980 MacGlashan, Jr. ..... 60/518
4,441,869 4/1984 Larsen et al. ..... 418/53

FOREIGN PATENT DOCUMENTS 466916 10/1928 Fed. Rep. of Germany ..... 418/53
360186 2/1906 France ..... 418/53
1259801 1/1972 United Kingdom .
1549269 7/1979 United Kingdom .

*Primary Examiner*—John J. Vrablik
*Attorney, Agent, or Firm*—Kenyon & Kenyon

[57] ABSTRACT

A power conversion machine which is provided with a spherical housing (10) with piston construction (36,37) having two-double-acting pistons (36) turnable about a first axis (x—x) cooperating with a partition plate (40) tiltable about a second axis (z—z) for defining four work chambers with piston surfaces (**36*a*, 36*b***) going forwards and backwards. The partition plate is connected forcibly to the piston construction so that the partition plate is subjected to a tilting movement while the piston construction is subjected to turning, without thereby turning the partition plate. Inlet openings and outlet openings which are placed one after the other in communication with the four work chambers, are opened and closed by a control effected by joint movement of the pistons and the partition plate.

9 Claims, 10 Drawing Sheets

POWER CONVERSION MACHINE HAVING PISTONS WHICH ARE MOVED IN A TURNING MOVEMENT IN A SPHERICAL HOUSING

The present invention relates to a power conversion machine having a pair of mutually opposite, separately double-acting pistons which are moved in a turning motion in a spherical housing, where the pistons are rigidly connected to each other via a common hub portion centrally in the spherical housing and are disposed each on its respective side of a centrally arranged, transversely extending partition plate which is locally passed through by the hub portion of the pistons and where the pistons at diametrically opposite ends, that is to say asymmetrically relative to each piston, are pivotably mounted each via its respective rotary pin in the spherical housing about a first axis.

From U.S. Pat. No. 4,441,869, a power conversion machine of the afore-mentioned kind is known. Two mutually coherent, oppositely directed, conic stump-shaped pistons are proposed which are rolled off on opposite sides of a common, stationary partition plate in the spherical housing. More specifically, pairs of alternately volume increasing and volume reducing work chambers are defined by means of each piston and a slide plate (hub portion) between the pistons, on opposite sides of the roller structure between the piston and the partition plate. Here one is dependent upon a slide plate which connects the pistons to each other and which is tiltable in a sealed-off slot in the stationary partition plate.

With the present invention the aim is a simpler and, in practice, more readily adaptable solution from a constructional and utilitarian viewpoint. In particular, the aim is a solution where one avoids the mentioned rolling off movements of the pistons against the partition plate and the axial sliding movement of the slide plate which connects the pistons to each other, and where one can, instead, employ a more readily controllable to-and-fro movement of the pistons and simultaneously a connection more readily sealable between the pistons and the partition plate.

The power conversion machine according to the invention is characterised in that each piston in a manner known per se has the form of a spherical segment with oppositely directed piston surfaces which outermost are terminated by the spherical surface of the spherical segment or the piston and which innermost are connected to each other via said hub portion with intermediate part-cylindrical hub portion surfaces which form bearing surfaces against equivalent part-cylindrical partition wall surfaces, and that the partition plate is pivotably mounted in the spherical housing about another axis which crosses the first axis in the centre of the spherical housing, the partition plate at opposite ends of the hub portion of the pistons being provided with bearing portions with a part-cylindrical bearing surface for each piston and with end bearing surfaces corresponding to end bearing surfaces in the hub portion of the pistons.

From United Kingdom Patent Specification Nos. 1,259,801 and 1,549,269 solutions are known where each piston has the form of a spherical segment with oppositely directed piston surfaces which are terminated outermost by the spherical surface of the spherical segment or the piston. The pistons define directly between them two oppositely acting work chambers.

By employing according to the invention a pivotably mounted partition plate one can obtain purely constructionally a simpler and more effective cooperating connection between the partition plate and the pistons. In particular the partition plate can be allowed to participate in certain movements together with the pistons and in other movements relative to the pistons, so that the change in volume can be achieved in the respective work chambers by a compound, forcibly controlled, relative movement of the pistons and the partition plate. More specifically the piston surface and the opposite surface of the partition plate can be tilted towards and away from each other, at the same time as the pistons and the partition surface move collectively in a mutually forcibly controlled manner relative to the inner surface of the spherical housing.

By employing according to the invention pistons in the form of spherical segments and a partition plate which is tiltably connected to the pistons, it can be made possible that the piston surfaces and equivalent, opposite surfaces in the partition plate are designed with varying form as required, in order to suit the compression conditions, opening and closing of inlet and outlet openings, possible valve openings, etc. in a manner most favourably possible according to the conditions. For example the said surfaces can be planar or have equivalent, more or less arbitrary curved contours by locally increasing or decreasing the thickness of the partition plate and the pistons.

According to the invention it will also be possible to set the size of the work chambers, all according to the dimensions which are established for the partition plate and the pistons and according to which angles are established between the rotary axis (said first axis) of the piston pins and the tilting axis (the hub axis) of the pistons.

According to the invention by means of the two pistons and the co-operating partition plate, over an angle of rotation of 360°, for each of the four work chambers, two successive work cycles can be achieved each with its respective suction and exhaust step (for example for two-stroke combustion engine) and a work cycle, respectively, with corresponding four work steps (four-stroke combustion engine). With an angle between the afore-mentioned axes of for example 35° one can get in each of the four work chambers of the machine a collective (to-and-fro) angular movement for each piston of 140° (4°×35°) and thereby a total angular movement for all four pistons of 560°. It is a substantial advantage for certain use examples according to the invention that each work cycle can be established for a 180° angle of rotation, of which almost one half of the angle of rotation (close to 90°) is employed for the inlet step, while almost the other half of the angle of rotation (close to 90°) is employed for the outlet step. Correspondingly, it is an advantage for other fields of use (for example for a four-stroke combustion engine) that each work cycle (four strokes I–IV) can be established for a 360° angle of rotation, of which almost one half of the angle of rotation can be employed for two of the strokes (for example the strokes I and II), while almost the other half of the angle of rotation can be employed for the other two ones of the strokes (for example, the strokes III and IV). Further it is in the last-mentioned case an advantage that two neigbour chambers one by one run through two successive work strokes. By the use of two motor units on one and the same axis one can let associated work chambers one by one run through all four work strokes (I–IV).

According to the invention one can in this way (in two-stroke combustion motor or in other motor or machine) achieve an effective control of the inlet step in two of the work chambers, while at the same time one has a correspondingly effective control of the outlet step in the two remaining work chambers. After a work cycle of 180° (rotating 180° in the spherical housing) with mutually successive inlet and outlet steps included therein, an equivalent further work cycle of 180° is achieved with corresponding inlet and outlet steps. If desired the angle between the said two axes can be set at a higher or lower angle than the said angle of 35°, in order thereby to alter the volume in each work chamber correspondingly for each work step.

Purely constructionally, it is preferred that the pistons and their common hub portion are passed through by a crank shaft which via a third axis of rotation is turnably mounted in the pistons and which has rotary and thrust bearings in each piston, the crank shaft being rigidly connected in a manner known per se to the said rotary pins.

In this way mounting of the pistons can be achieved in an effective manner with the associated hub portion on a common crank shaft passing through with the possibility for an effective through flow of lubricant in the bearing portions between crank shaft and the pistons. Simultaneously an effective sealing between the lubricant passage and the respective work chambers in the spherical housing can be ensured in a ready manner.

It is an essential advantage according to the invention that the pistons with associated common crank shaft together form a rigid body of rotation which is pivotable inside the spherical motor housing chamber, that is to say pivotable between two shaft journals which are pivotably mounted in the motor housing just outside the motor housing chamber. It is a corresponding advantage that the partition wall, which also is in the form of a rotation body, is tiltable in said motor housing chamber and is pivotably mounted in the motor housing just outside the motor housing chamber in the hollow space which is formed between the pistons and the crank shaft. One has the possibility to forcibly control the tilting movement of the partition wall in a an accurate and controlled manner within the rotary movement of the pistons, so that retardation forces are avoided both in the pistons and in the partition wall. One has also the possibility to form said members in a specially compact manner, with little need of space, that is to say with large volumetric efficiency. Further one has the possibility to achieve minimal friction with minimal fit tolerance and with an accurate adaptation of the members in relation to each other.

By having according to the invention a work cycle of 180° (against 270° by the solution according to Norwegian Patent Specification No. 81 0691) it is achieved a far simpler arrangement, with a simpler and more advantageous location of inlet and outlet openings and possibly other equipment, with a smaller number of valves or possibly without valves and with a simpler and more effective control of valves and other equipment. In addition it can be achieved relatively simple sealing where this is necessary.

The machine according to the invention can owing to the relatively high efficiency with a relatively small volume and thereby with little need of space be used for many different purposes of employment. For example, the machine can be used in the form of a compressor, pump, pneumatic or hydraulic motor, piston steam engine, Stirling motor, or the like In such a case the inlet openings and the outlet openings, respectively, can be controlled by the movements of the pistons and the partition plate, respectively, in relation to the spherical housing, without the use of valves or other control arrangements.

In case the machine is in the form of a four-stroke combustion engine, the exhaust openings and the scavenge air openings can be controlled partly by separate valves and partly by the partition plate and the pistons, respectively, by covering and uncovering, respectively, of the openings with the partition plate and the pistons, respectively. One can in this way in certain of the strokes control, that is to say keep open and keep closed, respectively, the exhaust openings and the scavenge air openings with valves, while the time and duration of the air scavenging and the exhaust emptying in its entirety can be controlled by the movements of the partition plate and the pistons, respectively.

In case the machine is in the form of a Stirling motor, the machine can consist of two motor units which each is connected to its end of a common shaft, the one motor unit being joined with a heating device, whereas the other motor unit being joined with a cooling device, and a heat exchanger being arranged about the common shaft between the cooling device and the heating device. It is thus in several ways achieved a specially favourable solution with the possibility of a tightly contracted motor with volumetric high efficiency. This causes that the machine, that is to say the Stirling motor, can have great employment in a series of different fields.

It is in the last-mentioned case preferred that the two motor units are connected with each other via an angle regulating device, for regulation of the working step of the motor units in relation to each other, the regulating device being preferably in the form of a pivot piston device which is controlled and hydraulically operated by a regulating valve, and that the regulating device is adjusted, by angle rotation of the motor units in relation to each other about a common rotating axis, to control the motor power and to rotate the pair of motor units for operation in two mutually opposite pivot directions, respectively.

Further features of the invention will be evident from the following description having regard to the accompanying drawings, in which.

Figure 7:
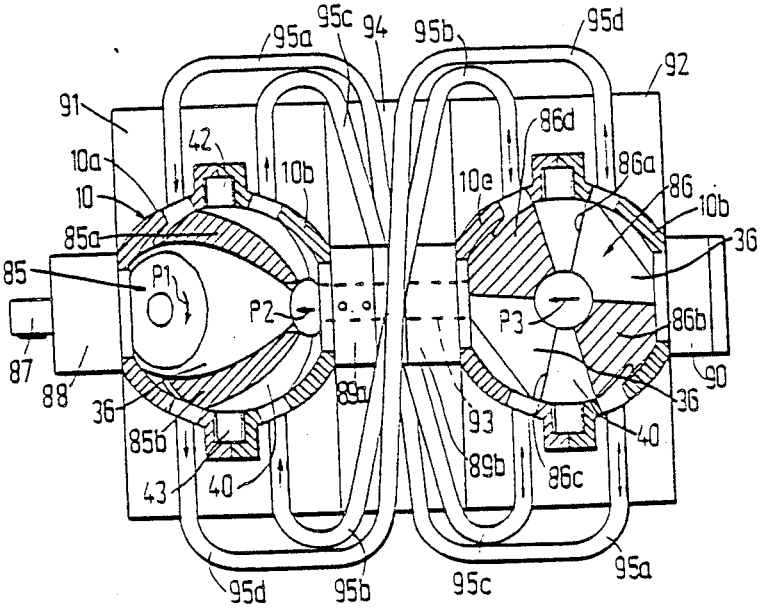
FIG. 7 shows schematically a machine according to the invention, in the form of an eight-chamber Sterling motor.
Figure 8:
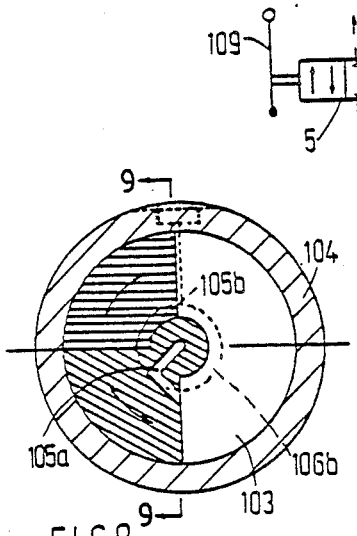
Figure 9:
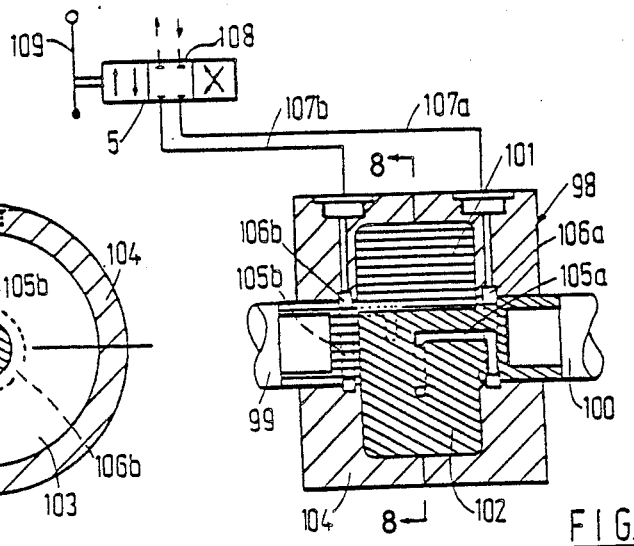

FIGS. 8 and 9 show a regulating device for the Stirling motor according to FIG. 7, shown by section 8—8 in FIG. 9 and by section 9—9 in FIG. 8, respectively.

Figure 10:
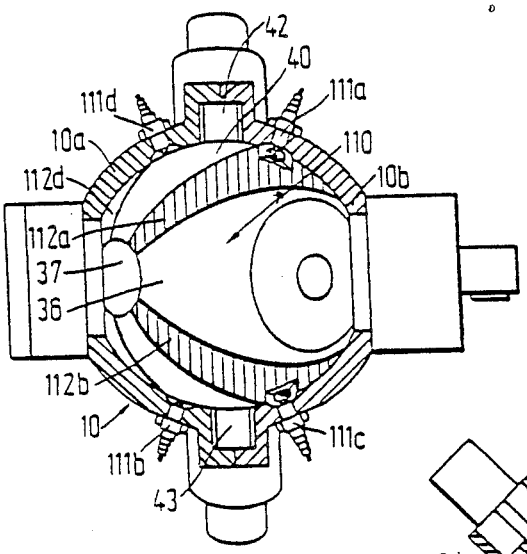
Figure 11:
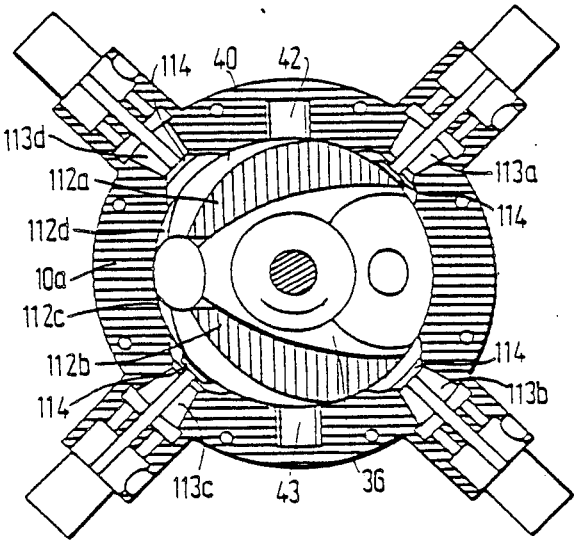

FIGS. 10 and 11 show a machine according to the invention, in the form of a four-stroke combustion engine.

Figure 12:
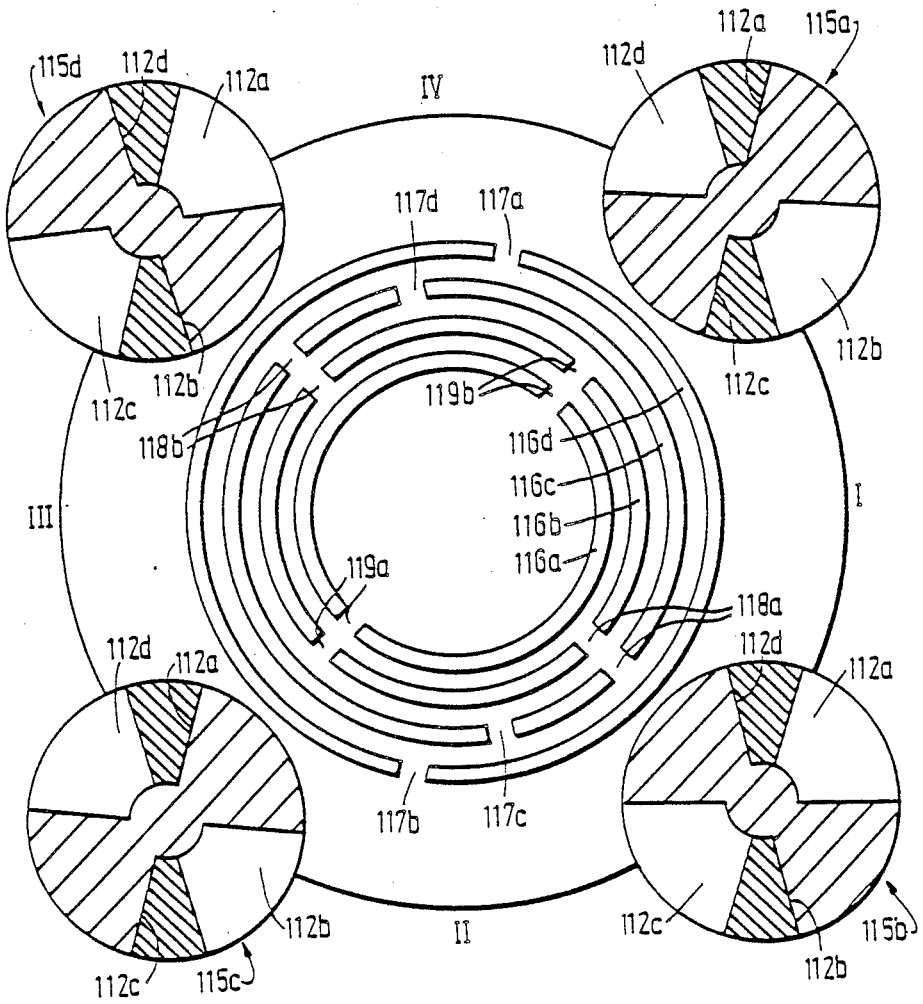

FIG. 12 shows schematically the four strokes for respective four motor chambers in the machine according to FIGS. 10 and 11.

Figure 13:
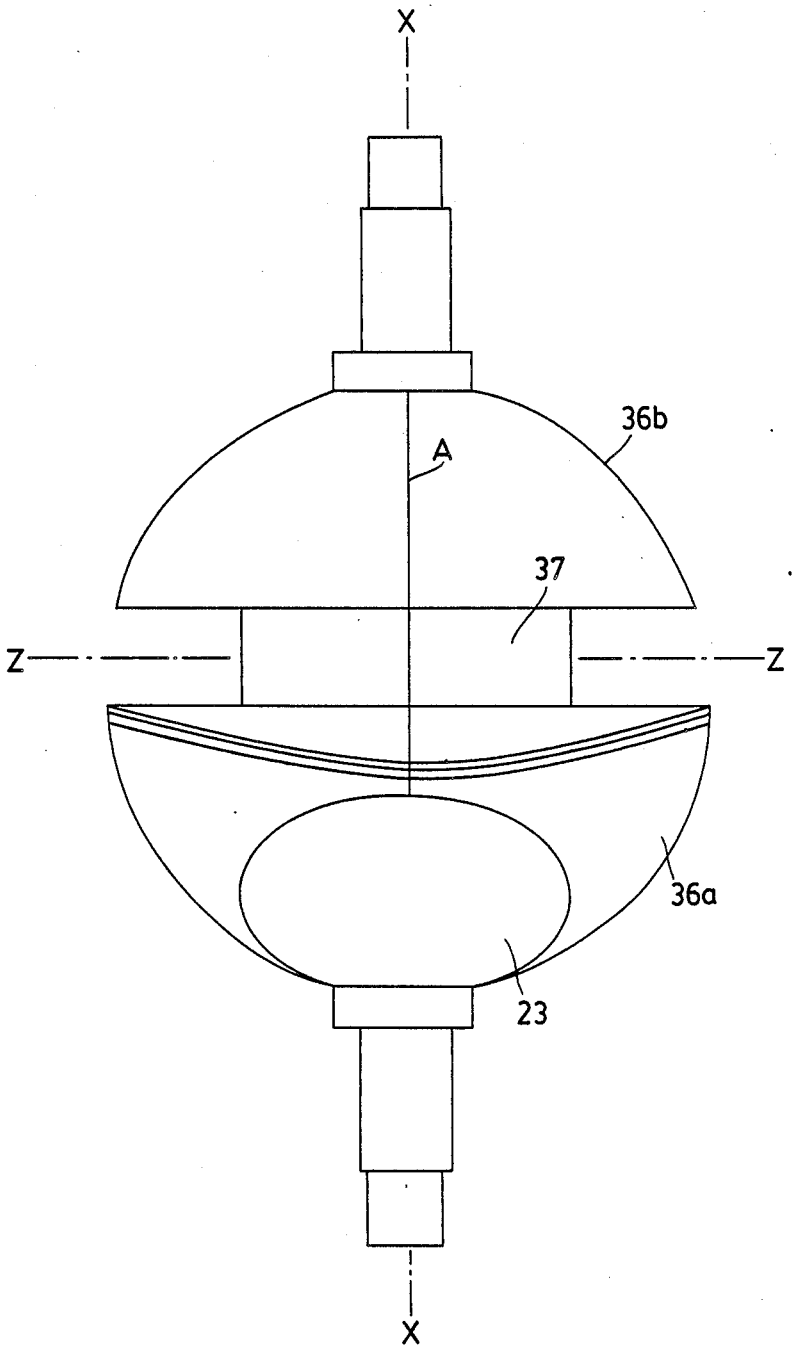
Figure 14:
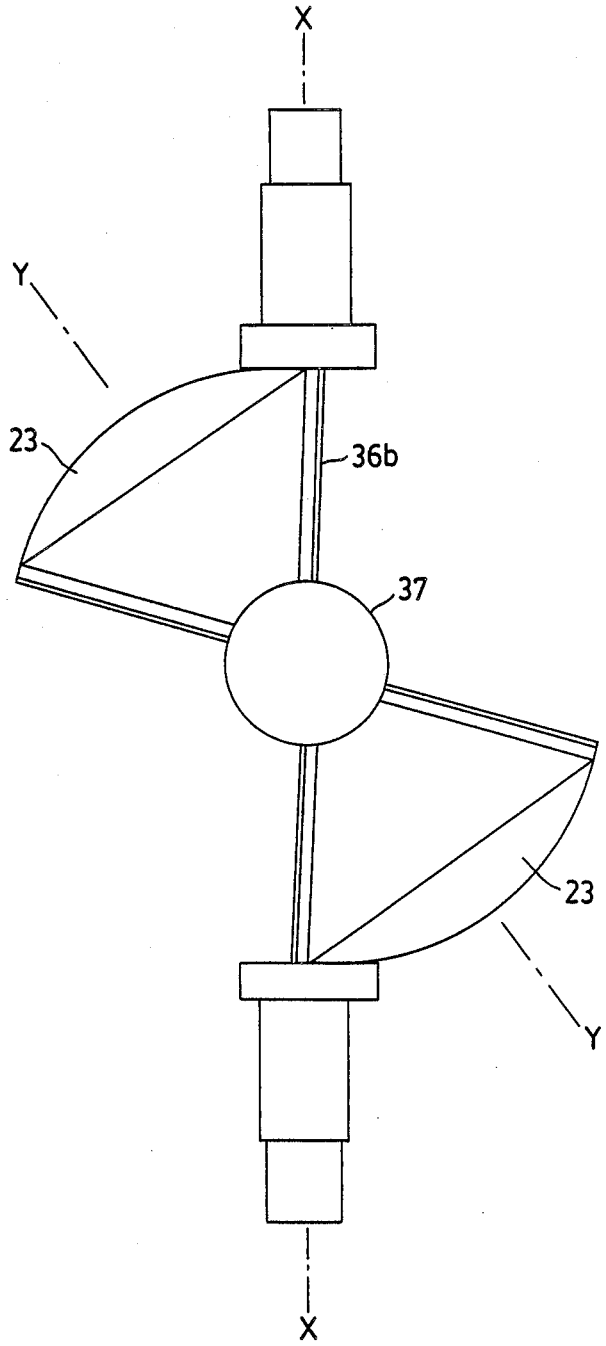
Figure 15:
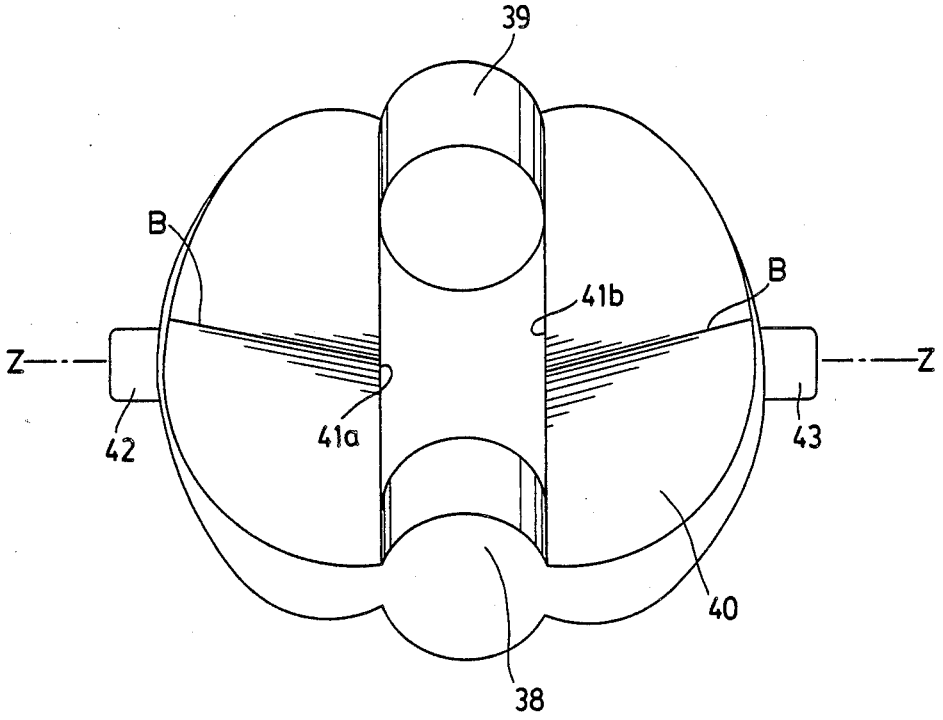

FIG. 13 illustrates a piston construction in accordance with the invention;

FIG. 14 illustrates a further view of the piston construction in accordance with the invention; and FIG. 15 illustrates a perspective view of a partition plate constructed in accordance with the invention.

In the drawings FIGS. 1–4 there is shown a power conversion machine which in the present embodiment example is illustrated in the form of a compressor for pumping gaseous pump medium and in the form of a pump for pumping liquid pump medium, respectively. Alternatively, the machine can be used as pneumatic or hydraulic motor driven by gaseous or liquid pressure medium, respectively.

A spherical housing 10 is illustrated which is made up of two in the main similar components 10*a* and 10*b*. The components 10*a*, 10*b* are jointed together via equivalent flange portions 11 with fastening holes 11*a* and associated fastening bolts 12, so that a spherical space 13 is defined internally in the housing.

Figure 1:
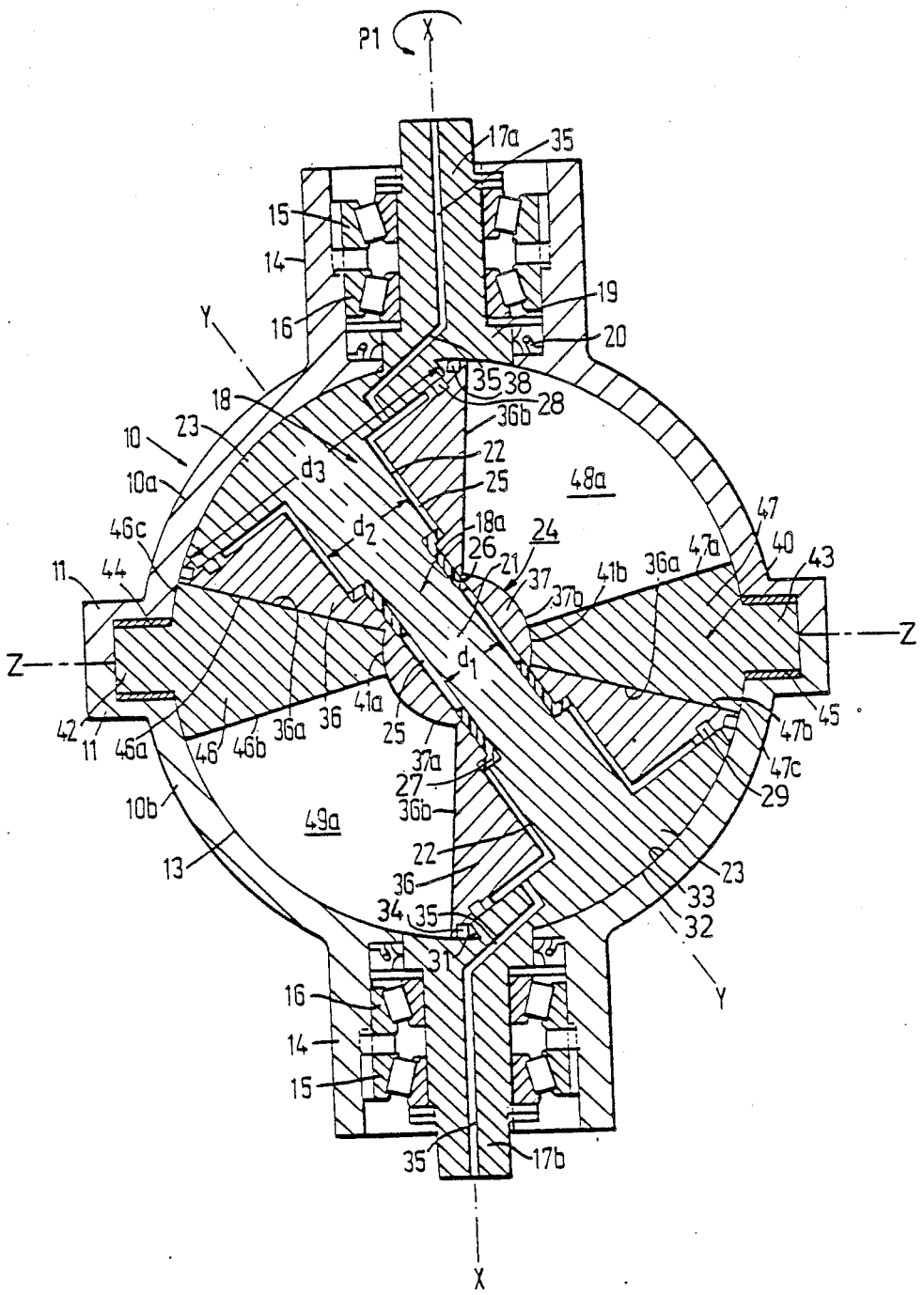
FIG. 1 shows a vertical section of the machine according to the invention, illustrated in the form of a compressor, with the pistons illustrated in the one outer position and with the section made centrally through the common crank shaft of the pistons.

Each housing component 10*a* and 10*b* is provided with a sleeve-shaped bearing portion 14 at the end opposite the flange portion 11. In the bearing portion 14 there is shown in FIG. 1 a pair of combined rotary and thrust bearings 15, 16 in which there are rotatably mounted a rotary pin 17*a* and 17*b*, which form a part of a crank shaft 18. The crank shaft 18 passes through the housing 10 with associated bearing portions 14. The main portion 18*a* of the crank shaft 18 is securely connected to the rotary pins 17*a* and 17*b*. In the illustrated embodiment the rotary pins and the main portion 18*a* of the crank shaft 18 are of unitary construction. In the transition between the rotary pin and the main portion 18*a* of the crank shaft there is a collar portion 19 which forms a seal against the bearing portion 14 via a gasket 20. The main portion 18*a* of the crank shaft 18 is provided with a central, cylindrical stem portion 21 having a minimum diameter d1 and a pair of opposite hub portions 22 with medium diameters d2 and a further pair of opposite spherical shell portions 23 having the maximum diameter d3.

The crank shaft 18 is turnably mounted about a first rotary axis x—x through the center of the rotary pins 17*a*, 17*b* and the center of the housing 10, while the main portion 18*b* of the crank shaft has a main axis y—y which in the illustrated embodiment forms an angle of 35° with the axis x—x. The main portion 18*a* of the crank shaft is turnably mounted in a piston construction 24 having an internal sectionally graduated bore 25 which receives the main portion 18*a* with a certain fit and with intermediate bushes 26, 27. At 28 and 29, seals are shown between the respective spherical shell portion 23 and the piston construction 24 and at 30 and 31 seals are shown between the spherical end surface 32 of the piston construction 24 and the internal spherical surface 33 of the housing 10 and the spherical inner surface 34 of the hub portion 22, respectively. There is shown a through passage 35 via the rotary pin 17*a*, the hub portion 22, the spherical shell portion 23 and the annular intermediate space between the main portion 18*a* of the crank shaft and the bore 25 in the piston construction together with the spherical shell portion, the hub portion and the rotary pin 17*a* at the opposite end of the crank shaft.

The piston construction 24 consists of two opposite pistons 36 together with an intermediate, common hub portion 37, which constitute a coherent unit. More specifically the piston construction 24 is fabricated in two half components (divided along the axis y—y and at right angles to the plane of the drawing in FIG. 1) which are fastened together with screw bolts or similar releasable fastening means in a manner not shown further. By this the piston construction can be mounted in position outside the crank shaft in a ready manner Each piston 36 is provided with two opposite piston surfaces 36*a*, 36*b* which are shown in the drawing in the form of planar surfaces at right angles to the plane of the drawing in FIG. 1. The intermediate hub portion 37 is provided with equivalent mutually opposite cylindrical sealing surfaces 37*a* and 37*b*. The hub portion 37 has a shorter dimension across the plane of the drawing in FIG. 1 than the pistons 36 and is provided at the ends with radial sealing surfaces which thrust axially against equivalent radial sealing surfaces in opposite hub portions 38 and 39 in a partition plate 40 (see FIG. 2). From FIG. 1 it is evident that the hub portion of the piston construction is arranged in a through slot in the partition plate 40 with seal-forming abutment via sealing surfaces 37*a* and 37*b* against concave sealing surfaces 41*a*, 41*b* in the slot which is cut out centrally in the partition plate 40.

Referring to FIGS. 13 and 14, the pistons 36*a*, 36*b* and hub 37 are divided in two halves along a partition line A. This allows mounting of the crank shaft therein.

Referring to FIG. 15, the partition plate 40 is also divided along a partition line B to allow for mounting of the pistons/hub member centrally in the partition plate 40.

As indicated, the pistons/hub member 36, 37 are arranged to be clamped centrally of the partition plate 40 in a gap (see FIG. 15) provided in the partition plate 40. The hub portion 37 is allowed to perform a rocking movement in the gap between concave sealing surfaces 41*a*, 41*b* and between the hub portions 38, 39 of the partition plate 40. Accordingly, the plate 40 is allowed to participate in part of the rocking or pivoting movement of the piston hub member 36, 37, and thus rock about the axis Z—Z.

The only connection that is provided between the partition plate 40 and the piston/hub member is the clamping provided between the hub portions 38, 39 and the hub portion 37 and between the sealing surfaces 41*a*, 41*b* and the hub portion 37. As indicated in FIG. 1, the partition plate 40 is pivoted about the axis Z—Z via the pivot pins 42, 43.

By pivoting on the axis X—X, the pistons/hub member 36, 37 causes a rocking movement of the piston/hub member 36, 37 about the axis Y—Y of the crank shaft member 18. This rocking movement of the piston/hub member 36, 37 is controlled by the partition plate 40.

More specifically, part of the rocking movement of the piston/hub member is allowed to take place by allowing the partition plate 40 to rock about the axis Z—Z. The remaining rocking movement of the pistons/hub member is provided by the rotation of the crank shaft member 18 in the pistons/hub member 36, 37.

The partition plate 40 is provided at its peripheral edge with two opposite pivot pins 42, 43 which are pivotably mounted in associated bearing sleeves 44, 45 in corresponding cavities in the flange portions mutually thrust together about an axis z—z. The partition plate is provided with two opposite disc portions 46, 47 in the form of spherical segments which are connected to each other via the said hub portions 38, 39 (see FIG. 2). For reasons of assembly the partition plate 40 is divided into two parts parallel to the plane of the drawing in FIG. 1 (see FIG. 15).

In FIG. 1 the pistons 36 are shown in their respective one outer position where a work chamber 48*a* and 49*a* is formed having a maximum volume on opposite sides of the partition plate 40 between the piston surface 36*b* and the partition plate surface 47*a* and 46*b*. Similarly there is formed a work chamber (48*b* and 49*b* as shown further in FIG. 3) having a minimum volume on opposite sides of the partition plate 40 between the piston surface 36*a* and the partition plate surface 47*b* and 46*a*.

Figure 2:
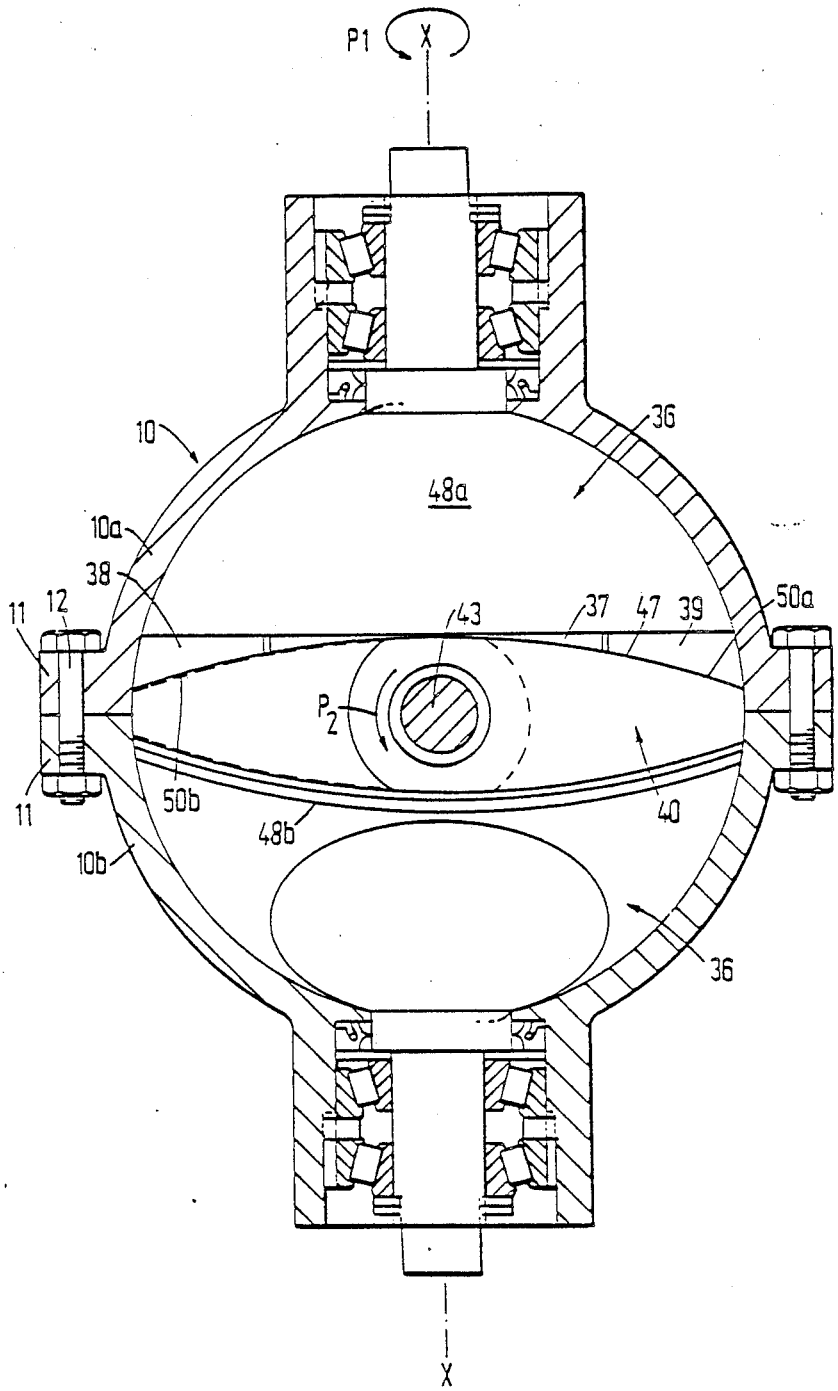
FIG. 2 shows partially in section and partially in side view the machine according to FIG. 1, with the same piston position as shown in FIG. 1, but illustrated in a section at right angles to the section in FIG. 1.

In FIG. 2 there is indicated by broken lines 50*a* the one of two inlet openings (which are arranged mutually diametrically opposite) in the spherical inner surface of the housing 10 just by the joint between the two housing components 10*a* and 10*b*. Similarly there is indicated by broken lines 50*b* the one of two outlet openings which are arranged in the spherical inner surface of the housing 10 just by the joint between the two housing components 10*a* and 10*b*. In FIG. 2 there is indicated the one inlet opening 50*a* and the one outlet opening 50*b* each arranged on its respective side of the pivot pin 42 of the partition plate 40, in the one portion of the housing 10 which is omitted in FIG. 2, while equivalent openings 50*b* and 50*a* are arranged in a similar manner each on its respective side of the other pivot pin 43 in the rear wall of the housing 10 in FIG. 2. In the position illustrated in FIG. 2 four openings combined are covered by the spherical end surfaces 46*c* (47*c*) of the partition plate 40. On swinging the partition plate 40 outwards from the position shown in FIG. 2—caused by a turning in the direction of rotation as illustrated by an arrow P1 of the crank shaft 18 with associated pistons 36 and hub portion 37 about the axis x—x and a corresponding tilting in the direction of tilt as shown by an arrow P2 of the partition plate 40 about its axis z—z—each of the openings 50*a* and 50*b* will be placed in communication with their respective work chambers 48*a*, 48*b*, 49*a*, 49*b*.

Figure 3:
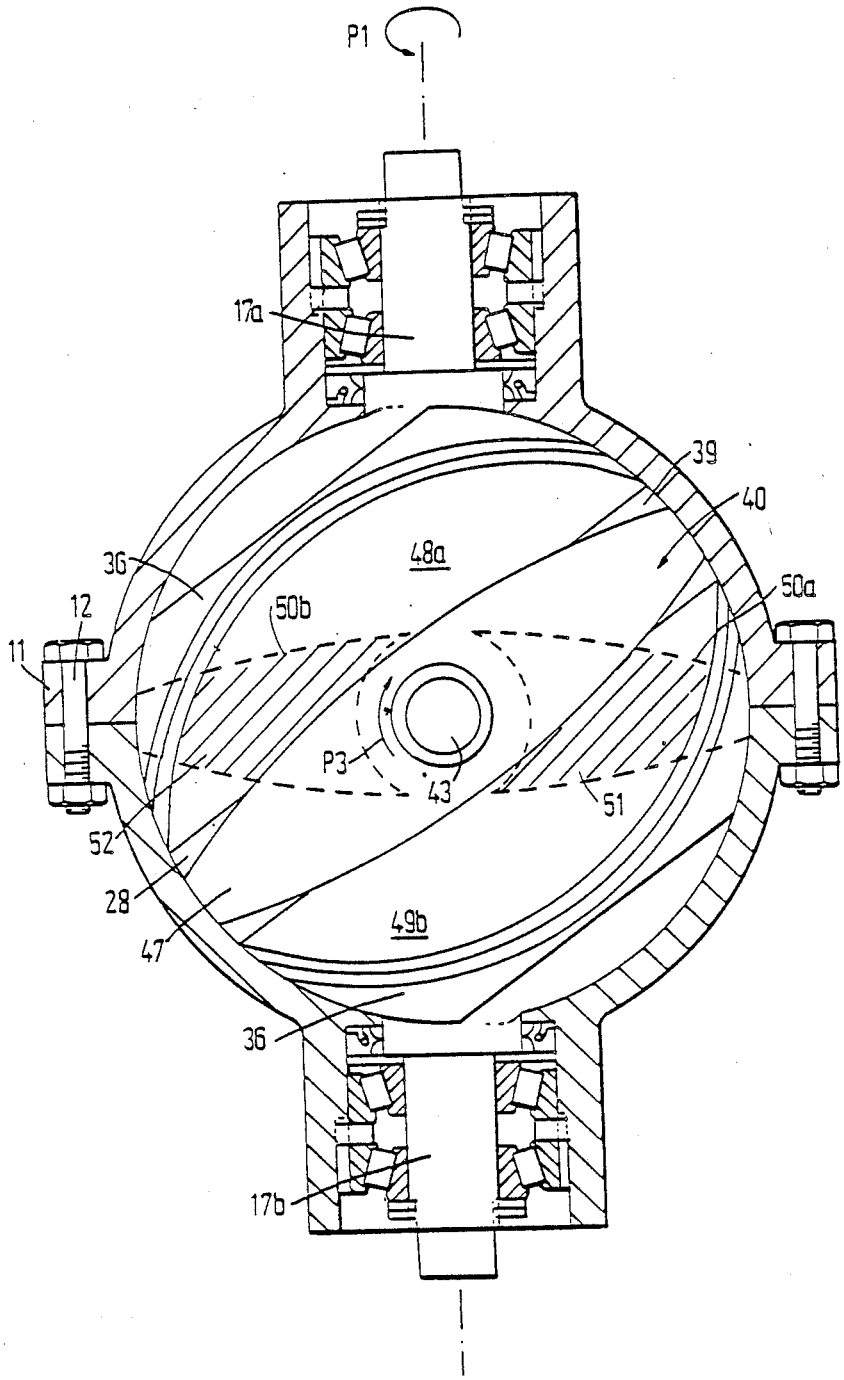
FIG. 3 shows the machine partially in section and partially in side view similarly as in FIG. 2 after a 45° turn of the crank shaft out of the position illustrated in FIG. 2.

In FIG. 3, the pistons 36 and the partition plate 40 are shown in an intermediate position between two outer positions, that is to say after turning of the pistons 36 90° about the axis x—x and a corresponding forcible retilting of the partition plate 40 35° about the axis z—z. In the intermediate position shown in FIG. 3 there is indicated an exposed area 51 and 52 (as indicated by cross-hatching) between the spherical end surface 47*c* (46*c*) of the partition plate 40 and the spherical end surface 36*c* of the respective piston 36. It will be evident from FIG. 3 that the areas 51 and 52 will be controlled by the movement of the partition plate 40 and the respective piston 36 jointly. From the position shown in FIG. 2 to the position shown in FIG. 3 the work chamber 48*a* (49*a*) will decline in volume while the work chamber 48*b* (49*b*) will increase in volume.

Figure 4:
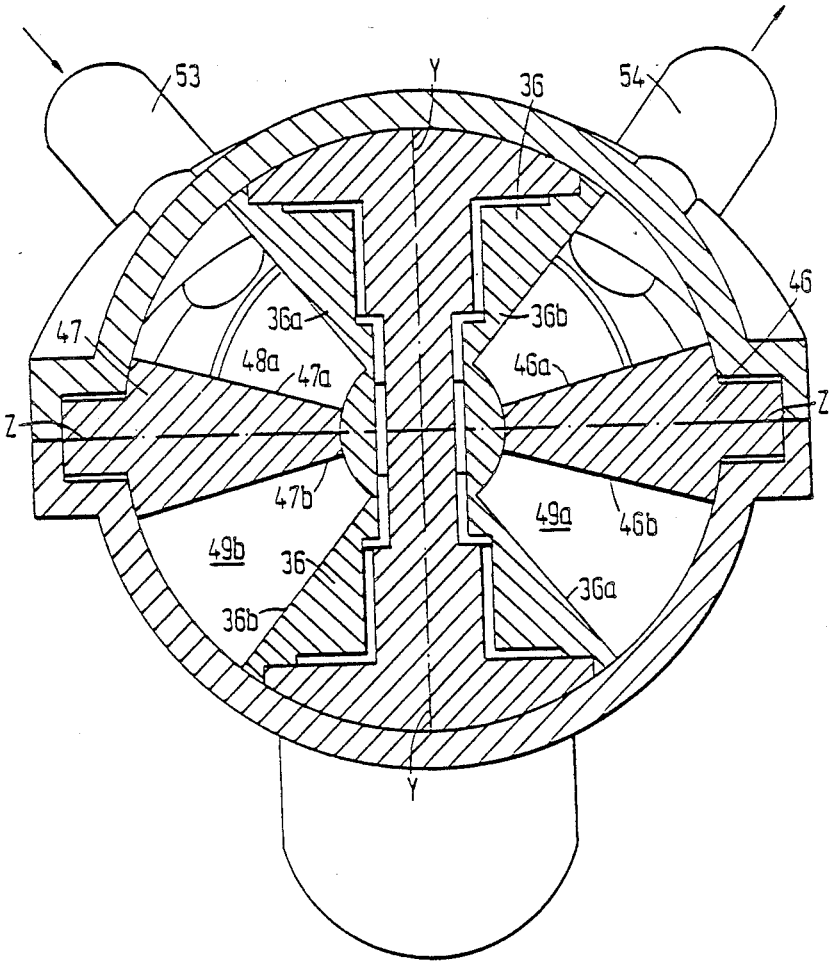
FIG. 4 shows a section made centrally through the common crank shaft of the pistons with the pistons shown in the same angular position as illustrated in FIG. 3.

From that in FIG. 3 to the other outer position of the pistons the partition plate 40 will tilt back towards the starting position of the partition plate as shown in FIG. 2, by tilting in the direction of tilt as shown by an arrow P3. By this reverse tilting of the partition plate the work chamber 48*a* (49*a*) will continue to decline in volume towards a minimum (similarly as indicated in FIG. 2 for the work chamber 48*b*), while correspondingly the work chamber 48*b* (49*b*) will continue to increase in volume towards a maximum, after turning of the piston construction 180° from the starting position as shown in FIG. 1 and 2. Thereafter the chamber 48*a* (49*a*) will increase in volume in a new equivalent cycle while the chamber 48*b* (49*b*) correspondingly declines in volume while the piston construction passes through the final 180° of a turn of 360° back to the starting position in FIG. 1 and 2. During this 360° turn each work chamber 48*a*, 48*b*, 49*a*, 49*b* has undertaken a fully closed work cycle with inlet and outlet (or outlet and inlet) of working medium, that is to say four equivalent volumes in pairs one after the other. In FIG. 4 there are shown two pipe stubs 53 and 54, each of which communicates with their respective associated inlet opening and outlet opening in the housing 10 in a manner not shown further via the wall portion at the flange portions 11 of the housing components 10*a*, 10*b*. Two further pipe stubs are similarly arranged on diametrically opposite wall portions of the housing connected to the two remaining openings (the inlet opening and the outlet opening).

In the illustrated embodiment in FIGS. 1–4 the invention is shown in the form of a compressor or pump for pumping gaseous or liquid working medium. However, the construction can as mentioned be used just as well in the form of a pneumatic or hydraulic motor which is driven by a gaseous or liquid working medium (pressure medium). In the following it shall as illustrating embodiments be described a variety of different machine types with associated additional equipment, but with main components corresponding to the main components according to the embodiment in FIGS. 1–4.

Figure 5:
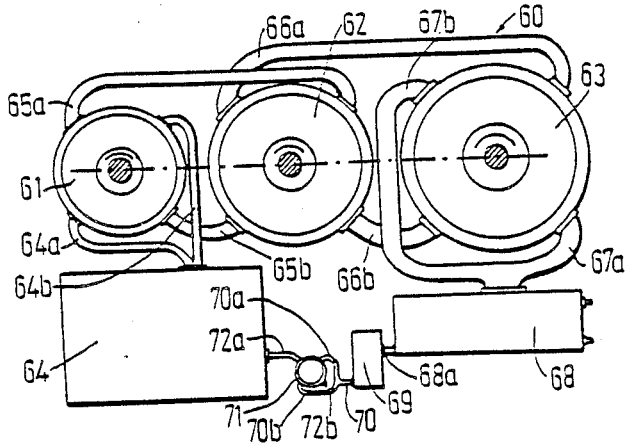
FIG. 5 shows schematically a machine according to the invention, in the form of a triple-expansion piston steam engine, where also the feed pump of the steam engine is made of a machine according to the invention.

A second embodiment as shown in FIG. 5 illustrates a triple-expansion piston steam engine 60 with three steam motors 61, 62, 63 connected in series. The motor 61 is fed with live steam from a steam boiler 64 via two parallel steam feed pipes 64*a*, 64*b*, while exhaust steam from the motor 61 is fed to the motor 62 via two parallel steam pipes 65*a*, 65*b* and exhaust steam from the motor 62 is fed via two steam pipes 66*a*, 66*b* to the motor 63 and exhaust steam from the motor 63 via two pipes 67*a*, 67*b* is fed to a steam condenser 68. From the condenser 68 is fed condensate via a pipe 68*a* to a cascade tank 69. From the cascade tank 69 a pipe 70 passes which branches off in two branch pipes 70, 70*b* to a four-chamber feed pump 71. From the feed pump 71 two branch pipes 72*a*, 72*b* pass to the steam boiler 64.

Figure 6:
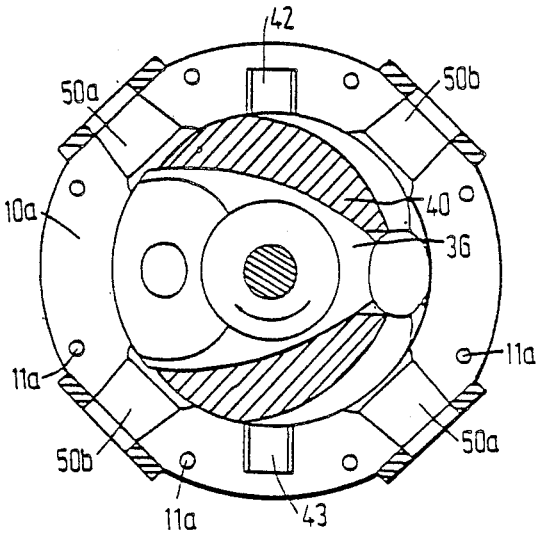
FIG. 6 shows a detail of the machines according to FIG. 5, illustrated in section.

Each of the motors 61, 62, 63 and the feed pump 71 is of corresponding general construction as shown in FIG. 6 and in FIG. 1–4, respectively.

In FIG. 6 it is shown the one section 10*a* of a two-piece housing 10. The partition is corresponding to that described in connection with the construction in FIGS. 1–4. In the housing it is shown a pair of mutually diametrically opposite inlet openings 50*a* and an equivalent pair of intermediate, mutually diametrically opposite outlet openings 50*b* which are opened and closed, without the use of extra valves, controlled by the movement of a partition plate 40 corresponding to the partition plate in FIGS. 1–4 and controlled by pistons 36 corresponding to the pistons in FIGS. 1–4, respectively, in relation to the interior surfaces of the housing sections. The partition plate 40 is mounted tiltably about pivot pins 42, 43 in the housing 10 in a corresponding manner as shown for the pivot pins in FIGS. 1–4. The construction and the mode of operation for the partition plate 40 and the pistons 36 are corresponding to what is described for the partition plate 40 and the pistons 36 according to FIGS. 1–4.

In FIG. 7 the machine according to the invention is shown in the form of a eight-chamber Stirling motor or engine with a closed, regenerative circuit with heat recovery, where the work medium is compressed and expanded at different temperature levels. The Stirling motor or engine can be constructed as motor, heat pump, pressure generator and cooling engine, respectively, or the like, as required. In the illustrated embodiment the Stirling motor is intended used as motor, with external combustion or other external heating and with equivalent external cooling.

It is shown a schematic arrangement of two motor units 85, 86, connected in series, connected to a common drive shaft via bearings **88, 89*a*, 89*b*, 90. The one motor unit 85 is surrounded by a cooling device 91 (the periphery indicated in fully drawn lines) and the other motor unit is correspondingly surrounded by a heating device 92 (the periphery indicated in fully drawn lines). A shaft connection 93 (indicated in broken lines) between the motor units 85, 86 and the associated bearings 89*a*, 89*b* is surrounded by a heat exchanger or ordinary regenerator 94** (the periphery indicated in fully drawn lines).

By the solution according to the present invention it is so arranged that the one, cooled motor unit 85 has four separate chambers, of which only two chambers **85*a*, 85*b* are illustrated in FIG. 7, while the other motor unit 86 has equivalent four separate chambers 86*a*, 86*b*, 86*c*, 86*d*. It is shown four separate guide passages 95*a*, 95*b*, 95*c*, 95*d* between the two motor units 85, 86**. More precisely, each of the four chambers in the one motor unit is connected with their respective chamber in the other motor unit via their respective said passages. In this way it is achieved an arrangement with two pairs of double acting pistons, that is to say two double acting pistons in each motor unit. The pistons in the one motor unit is 90° phase-displaced in relation to the pistons in the other motor unit. This causes that the pistons of the two motor units in certain parts of the work cycle compress the medium between them while they in certain other parts of the work cycle let the medium expand between them and in further parts of the work cycle allow transmission of the medium from work chamber to work chamber. (Ordinary Stirling cycle to a system of two parts of double acting pistons).

It is not shown the details of the cooling device 91 or of the heating device 92 and the heat exchanger, respectively, as FIG. 7 illustrates the solution as a principle sketch, without laying special emphasis on the details. For example, the passages can be made substantially different from what is shown in the drawings, with regard to length extension as well as to general course, as will easily be evident to the skilled man. However, it is a demand that the pipes have mutually the same length and mutually the same volume.

With arrows P2 it is shown the one of the two opposite tilting directions for the partition wall 40 in the two motor units and with arrows P1 it is shown the pivot direction for the piston construction with the two pistons 36. The pistons 36 in the one motor unit 86 are shown in the one external position, while the pistons 36 in the other motor unit 85 take an intermediate position. The piston arrangements of the two motor units are in FIG. 7 shown angularly displaced 90° in relation to each other relative to the rotation axis, so that the work chambers of the one motor unit the whole time are lying 90° phase-displaced in relation to the work chambers in the other motor unit.

An essential part of the solution according to the invention is that it is used two motor units, which individually both in construction and in mode of operation mainly correspond to the solution as shown in FIGS. 1–4. However, it must be remarked that in the solution according to the invention, with regard to the Stirling motor, it is not used any form of valve, as the pipes at opposite ends are in permanently open connection with equivalent work chambers in the two motor units, without any covering of the connection to the respective work chamber. An essential advantage according to the invention is that the Stirling motor has got a condensed constructional solution simultaneously as it can be achieved a particularly high efficiency with a relatively minimal volume and thereby minimal need of space and with considerable saving of material and saving of associated equipment.

By using, according to the invention, two such motor units 85, 86 one has according to the invention further been able to utilize the possibility to undertake an adjustable regulation of the angular position between the two piston arrangements. In FIGS. 8 and 9 it is shown a hydraulic coupling 98 between a shaft journal 99 in the one motor unit and a shaft journal 100 in the other motor unit. The one shaft journal 99 is rigidly connected with a first piston member 101 and the other shaft journal is correspondingly rigidly connected with a second member 102. The piston members 101, 102 are arranged in a common chamber 103 in a common housing 104. It is shown hydraulic passages **105*a* and 105*b*, respectively, between the chamber 103 and a ring chamber 106*a* and 106*b*, respectively, and pipe connections 107*a* and 107*b*, respectively, to a three-way regulating valve 108. By means of a handle 109 in the valve 108 one can by hydraulic control medium turn the piston members 101 and 102 towards and from each other, as required. Precisely defined, the piston members can be turned from the external position 180° shown in FIG. 8 to the other external position via an intermediate position (90°) which corresponds to the position as shown in FIG. 7, that is to say with 90° angular displacement between the piston arrangements in the two motor units. From the position which is shown in FIG. 7** the piston arrangements can be turned 90° in opposite directions towards respective two external positions. This causes that one can reduce the angular deviation from 90° towards 0° in opposite directions. In both cases the efficiency can be brought down towards zero. From the external position one can begin with zero efficiency and stepwise increase this towards a maximum by increase of the angular deviation to and beyond 90°, respectively. According to which external position the piston members have taken in relation to each other, one can begin from zero and continue towards maximum efficiency in respective two opposite directions. In other words, there is the possibility to reverse the drive direction in particularly simple manner from a stop position, as the pivot direction is determined by the external position chosen as starting point. Thereafter the deviation can be increased to 90° and continued with further increase of efficiency by increasing the deviation beyond 90°. Consequently, there is the possibility to ensure an effective regulation of the motor power in a relatively simple and easy manner by change of the angular deviation between the motor units and to reverse the pivot direction from forward operation to backward operation, and vice versa, according to which external position it has been moved towards.

In FIGS. 10, 11 and 12 the invention is illustrated in connection with a four-stroke combustion engine 110 with a housing 10 made of two joined housing sections 10*a* and 10*b*. A similar arrangement can also be used in connection with a two-stroke combustion engine.

In FIG. 10 it is indicated four combined sparking-plugs and fuel valves 11*a*, 111*b*, 111*c*, 111*d*, that is to say a unity of sparking-plug and fuel valve for its respective chamber 112*a*, 112*b*, 112*c*, 112*d*. Further, it is shown two valve controlled exhaust passages 113*a* and 113*c* and two valve controlled scavenge air passages 113*b* and 113*d*, each with its separate valve 114, that is to say a passage for its respective pair of chambers. The contemporary control of sparking-plugs and fuel valves can take place in a manner known per se by means of known principles. The contemporary control of the opening and closing of the exhaust passages and the scavenge air passages can partly take place by valve control and partly by slide-like uncovering and covering, respectively, by means of the partition plate 40 and the pistons 36, respectively. The disposition of sparking-plugs, fuel nozzles and exhaust passage outlet is localized so in relation to the motion paths of the partition plate 40 and of the pistons 36, respectively, that the most favourably possible effect is achieved.

By a two-stroke combustion engine (not shown further) it is required to control the air scavenge valve separately, while the exhaust passage can be opened and closed only by control of the pistons and the partition wall, respectively, or only by control of the partition wall. The air scavenging must take place by overpressure (overcharger).

The valves 114 of the respective exhaust passages and the pivot pins 42, 43 of the partition wall 40 are mounted in respective cavities in the motor housing, that is to say in the joint surfaces between the housing sections 10*a*, 10*b*.

In FIG. 12 it is shown schematically the four strokes in the four-stroke motor, illustrated by four part sketches as shown by the reference numerals 115*a*, 115*b*, 115*c* and 115*d* and which show the working steps (I–IV) for the respective four different work chambers 112*a*–112*d* localized between the partition wall 40 and the two valves 36.

By means of four centrally located, (imaginary) rings 116*a*, 116*b*, 116*c*, 116*d* arranged concentrically in relation to each other (one for each stroke I–IV) it is by means of openings 117*a*, 117*b*, 117*c* and 117*d* marked an open connection (in respective ring or stroke) for the four fuel valves/sparking-plugs 11*a*–111*d* (FIG.. 10) and by means of openings 118*a* and 118*b* marked an open connection (in respective ring or stroke) for the two exhaust valves 113*a* and 113*c* (FIG. 11) and by means of openings 119*a* and 119*b* marked an open connection (in respective ring or stroke) for the two air scavenge valves 113*b* and 113*d* (FIG. 11).

It will appear from FIG. 12 that two and two of the work chambers in the motor in each part sketch (115*a*–115*d*), that is to say the two work chambers 112*b*, 112*c* and 112*b*, 12*d*, respectively, which are arranged diametrically opposite each other, are working in the same stroke. Further, it will appear that the two neighbour work chambers 112*a*, 112*b*, which are lying each on its side of the one piston 36 and on the same side of the partition plate 40, have each its mutually succeeding stroke. Correspondingly, the work chambers 112*c* and 112*d* have each its mutually succeeding stroke, that is to say corresponding stroke as the work chambers 112*a* and 112*b*, respectively. In each of the strokes I–IV as shown in the part sketches 115*a*–115*d* it is consecutively used only two of the four strokes I–IV. In practice this can be solved by the use of fly wheel. Alternatively, it can be used two motor units in series, where the work chambers in the one motor unit are working with two strokes (for example, the strokes I and II) before the strokes (for example, the strokes II and IV) in the work chambers in the other motor unit, so that the four strokes at any time are distributed between the work chambers of the two motor units.

In a two-stroke motor the two strokes are correspondingly arranged in pairs on opposite sides of the piston and on opposite sides of the partition plate and normally fly wheel and/or an extra motor unit are not required. Both wih regard to the four-stroke motor and the two-stroke motor it can, however, be used two or more motor units on one and the same shaft.

By to-and-fro tilting of the partition plate 40 (not shown further in FIG. 12), controlled by the rotary motion of the pistons 36 and therefrom following forcibly to-and-fro tilting (as shown in FIG. 12), the shown work strokes I–IV (part sketches 115*a*–115*d*) for the four-stroke motor are achieved. The beginning of the uncovering (that is to say the opening of the different inlets and outlets of the motor chambers) takes angularly place mainly as indicated by openings in the shown rings 116*a*–116*d* and angularly related to the different sketches 115*a*–115*d*. It is in FIG. 12 only indicated generally by means of the rings 116*a*–116*d* in which strokes the different valves etc. are activated, without laying too much emnphasis on the positions of these angularly in relation to each other, as the angle positions are only shown suggestively. Nor is it angularly suggested anything about how large part of the stroke (or the succeeding stroke) that is included by the uncovering.

In stroke I it is only the fuel valvet/the sparking-plug 111*a* (shown at the opening 117*a*) in a first chamber 112*a* and the fuel valve/the sparking-plug 111*b* (shown at the opening 117*b*) in the diametrically opposite chamber 112*c* which are activated.

In stroke II it is the fuel valve/the sparking-plug 111*c* (shown at the opening 117*c*) and 111*d* (shown at the opening 117*d*), respectively, for the mutually diametrically opposite chambers 112*b* and 112*d* which are activated. In the same stroke II it is the exhaust passages 113*a* and 113*c* (shown at the openings 118*a*, 118*b*) for the chambers 112*a* and 112*c* which are activated.

In stroke III it is the same exhaust passages 113*a* and 113*c* (the openings 118*a*, 118*b*) which are activated for the chambers 112*b* and 112*d*. In the same stroke II it is the scavenge air passages 113*b* and 113*d* (shown at the openings 119*a*, 119*b*) which are activated for the chambers 112*a* and 112*c*.

In stroke IV it is the same scavenge air passages 113b and 113d (the openings 119a, 119b) which are activated for the chambers 112b and 112d.

From the above statement it will appear that the four fuel valves/the sparking-plugs 111a–111d are activated separately, for example by electronic control and without control by pistons or partition plate. In practice the exhaust passages 113a and 113c will be open in two first strokes and closed in two succeeeding strokes, that is to say uncovered one by one opposite two neighbour chambers and then controlled by the piston 36 mutually between the two neighbour chambers. Correspondingly, the scavenge air passages 113b and 113d will be open in the two first strokes and closed in two succeeding strokes, that is to say uncovered one by one opposite two neighbour chambers and then controlled by the piston 36 mutually between the two neighbour chambers.

I claim:

1. A power conversion machine comprising a spherical housing;

a piston construction mounted in said housing for rotation about a first axis, said piston construction including a central hub portion with part-cylindrical surfaces and a pair of double acting pistons, each piston being connected on an opposite side of said hub on a second axis passing through said first axis at a common point in a center of said housing and being in the form of a spherical segment with oppositely directed piston surfaces; and a partition plate pivotally mounted in and across said housing on a third axis intersecting said common point, said partition plate receiving said hub portion centrally thereof and having bearing surfaces bearing on said hub and part-cylindrical bearing surfaces for slidably receiving said pistons.

2. A machine as set forth in claim 1 which further comprises a crank shaft rotatably mounted on said first axis and passing centrally through said piston construction, a pair of rotary pins, each pin being connected at one end of said crank shaft and rotatably mounted in said housing on said first axis, and bearings mounting said pistons on said crank shaft.

3. A machine as set forth in claim 2 wherein said crank shaft and said pins are of unitary construction and said pistons and said hub portion are of two-piece construction.

4. A machine as set forth in claim 1 wherein said partition plate has spherical end surfaces for selectively opening and closing over inlet and outlet openings in said housing for selective communication with work chambers defined on opposite sides of said plate by said pistons.

5. A machine as set forth in claim 4 wherein said partition plate has a pair of pivot pins at diametrically opposite points rotatably mounted in said housing, said plate having a peripheral thickness tapering from adjacent end pin to a thin thickness at a peripheral point intermediately of said pins, said plate being of two-piece construction divided symmetrically of said hub portion.

6. A machine as set forth in claim 4 wherein each of said openings in said housing is sized to be covered and uncovered by said spherical end surface of said plate and a spherical end surface of a respective piston.

7. A machine as set forth in claim 4 which further comprises a plurality of valves, each said valve being connected to a respective one of said openings to define a four-stroke combustion engine.

8. A machine as set forth in claim 1 is in the form of one of a compressor, pump, pneumatic motor, hydraulic motor and steam engine.

9. A Stirling engine comprising a pair of power conversion machines, each machine including a spherical housing, a piston construction in said housing including a central hub portion and a pair of double-acting pistons connected to said hub on opposite sides of a common axis, each piston being in the form of a spherical segment with oppositely directed piston surfaces; and a partition plate pivotally mounted in said housing on a second axis intersecting said common axis, said plate having bearing surfaces bearing on said hub and bearing surfaces slidably receiving said pistons;

a drive shaft connected in common to said machines;

an angle regulating device connecting said machines together for regulation of the working steps of said machines in relation to each other, said regulating device including a pivot piston device and a regulatory valve operatively connected to said piston device to rotate said machines in opposite pivot directions;

a heating device connected to one of said machines;

a cooling device connected to the other of said machines; and a heat exchanger about said drive shaft between said devices.

* * * * *

UNITED STATES PATENT AND TRADEMARK OFFICE

CERTIFICATE OF CORRECTION

PATENT NO. : 4,938,025

DATED : July 3, 1990

INVENTOR(S) : Thor Larsen

It is certified that error appears in the above-identified patent and that said Letters Patent is hereby corrected as shown below:

Column 3, line 45, delete "a"

Column 5, line 6, change "Sterling" to --Stirling--

Column 9, line 13, change "a" to --an--

Column 9, line 20, change "intended" to --intended to be--

Column 11, line 18, change "11a" to --111a--

Column 11, line 62, change "11a" to --111a--

Column 12, line 4, change "12d" to --112d--

Column 12, line 28, change "wih" to --with--

Column 12, line 51, change "valvet" to --valve--

Signed and Sealed this

Fourth Day of May, 1993

*Attest:*

Michael K. Kirk

MICHAEL K. KIRK

*Attesting Officer*

*Acting Commissioner of Patents and Trademarks*